US011134330B2

(12) United States Patent
Watts et al.

(10) Patent No.: US 11,134,330 B2
(45) **Date of Patent: *Sep. 28, 2021**

(54) EARBUD SPEECH ESTIMATION

(71) Applicant: Cirrus Logic International Semiconductor Ltd., Edinburgh (GB)

(72) Inventors: David Leigh Watts, Cremorne (AU); Brenton Robert Steele, Cremorne (AU); Thomas Ivan Harvey, Cremorne (AU); Vitaliy Sapozhnykov, Cremorne (AU)

(73) Assignee: Cirrus Logic, Inc., Austin, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/509,711

(22) Filed: Jul. 12, 2019

(65) Prior Publication Data

US 2019/0342652 A1 Nov. 7, 2019

Related U.S. Application Data

(63) Continuation of application No. 16/009,524, filed on Jun. 15, 2018, now Pat. No. 10,397,687.
(Continued)

(51) Int. Cl.

| | |
|---|---|
| ***H04R 1/10*** | (2006.01) |
| ***G10L 21/0208*** | (2013.01) |
| ***H04R 1/46*** | (2006.01) |
| ***G10L 25/78*** | (2013.01) |
| *G10L 21/0216* | (2013.01) |
| *H04R 3/00* | (2006.01) |

(52) U.S. Cl.
CPC ..... *H04R 1/1041* (2013.01); *G10L 21/0208* (2013.01); *G10L 25/78* (2013.01); *H04R 1/1016* (2013.01); *H04R 1/1083* (2013.01); *H04R 1/46* (2013.01); *G10L 2021/02161* (2013.01); *H04R 1/1075* (2013.01); *H04R 3/005* (2013.01); *H04R 2420/07* (2013.01); *H04R 2460/13* (2013.01)

(58) Field of Classification Search
CPC .. H04R 1/1041; H04R 1/1016; H04R 1/1083; H04R 2420/07; H04R 2460/13; H04R 1/46; H04R 1/1075; H04R 3/005; G10L 25/78; G10L 21/0208; G10L 2021/02161
See application file for complete search history.

(56) References Cited

U.S. PATENT DOCUMENTS 5,999,897 A * 12/1999 Yeldener ..... G10L 25/90 704/207
8,983,096 B2 3/2015 Smith et al.
(Continued)

FOREIGN PATENT DOCUMENTS

| | | |
|---|---|---|
| EP | 2811485 A1 | 12/2014 |
| JP | 2003264883 | 9/2003 |
| WO | 2016209530 A1 | 12/2016 |

*Primary Examiner* — Jason R Kurr
(74) *Attorney, Agent, or Firm* — Jackson Walker L.L.P.

(57) ABSTRACT

Embodiments of the invention determine a speech estimate using a bone conduction sensor or accelerometer, without employing voice activity detection gating of speech estimation. Speech estimation is based either exclusively on the bone conduction signal, or is performed in combination with a microphone signal. The speech estimate is then used to condition an output signal of the microphone. There are multiple use cases for speech processing in audio devices.

18 Claims, 10 Drawing Sheets

Related U.S. Application Data

(60) Provisional application No. 62/520,713, filed on Jun. 16, 2017.

(56) References Cited

U.S. PATENT DOCUMENTS

| | | | | |
|---|---|---|---|---|
| 9,313,572 | B2 | 4/2016 | Dusan et al. | |
| 9,363,596 | B2 | 6/2016 | Dusan et al. | |
| 9,516,442 | B1 | 12/2016 | Dusan et al. | |
| 9,997,173 | B2 | 6/2018 | Dusan et al. | |
| 2005/0114124 | A1* | 5/2005 | Liu | G10L 21/0208 704/228 |
| 2006/0072767 | A1* | 4/2006 | Zhang | H04R 3/005 381/71.6 |
| 2009/0296965 | A1* | 12/2009 | Kojima | H04R 25/407 381/312 |
| 2014/0072148 | A1 | 3/2014 | Smith et al. | |
| 2014/0119548 | A1* | 5/2014 | Kechichian | H04R 29/00 381/56 |
| 2016/0118035 | A1 | 4/2016 | Hyde et al. | |
| 2017/0263267 | A1* | 9/2017 | Dusan | G10L 25/78 |
| 2017/0365249 | A1* | 12/2017 | Dusan | G10L 15/05 |
| 2018/0081621 | A1 | 3/2018 | Dusan et al. | |
| 2018/0122354 | A1* | 5/2018 | Boesen | H04R 1/1083 |
| 2018/0324518 | A1 | 11/2018 | Dusan et al. | |

* cited by examiner

EARBUD SPEECH ESTIMATION

CROSS-REFERENCE TO RELATED APPLICATIONS

This application is a continuation of U.S. Non-provisional patent application Ser. No. 16/009,524, filed Jun. 15, 2018, now U.S. Pat. No. 10/397,687, which claims the benefit of U.S. Provisional Patent Application No. 62/520,713 filed 16 Jun. 2017, each of which is incorporated herein by reference.

FIELD OF THE INVENTION

The present invention relates to an earbud headset configured to perform speech estimation, for functions such as speech capture, and in particular the present invention relates to earbud speech estimation based upon a bone conduction sensor signal.

BACKGROUND OF THE INVENTION

Headsets are a popular way for a user to listen to music or audio privately, or to make a hands-free phone call, or to deliver voice commands to a voice recognition system. A wide range of headset form factors, i.e. types of headsets, are available, including earbuds. The in-ear position of an earbud when in use presents particular challenges to this form factor. The in-ear position of an earbud heavily constrains the geometry of the device and significantly limits the ability to position microphones widely apart, as is required for functions such as beam forming or sidelobe cancellation. Additionally, for wireless earbuds the small form factor places significant limitations on battery size and thus the power budget. Moreover, the anatomy of the ear canal and pinna somewhat occludes the acoustic signal path from the user's mouth to microphones of the earbud when placed within the ear canal, increasing the difficulty of the task of differentiating the user's own voice from the voices of other people nearby.

Speech capture generally refers to the situation where the headset user's voice is captured and any surrounding noise, including the voices of other people, is minimised. Common scenarios for this use case are when the user is making a voice call, or interacting with a speech recognition system. Both of these scenarios place stringent requirements on the underlying algorithms. For voice calls, telephony standards and user requirements demand that high levels of noise reduction are achieved with excellent sound quality. Similarly, speech recognition systems typically require the audio signal to have minimal modification, while removing as much noise as possible. Numerous signal processing algorithms exist in which it is important for operation of the algorithm to change, depending on whether or not the user is speaking. Voice activity detection, being the processing of an input signal to determine the presence or absence of speech in the signal, is thus an important aspect of voice capture and other such signal processing algorithms. However, even in larger headsets such as booms, pendants, and supra-aural headsets, it is very difficult to reliably ignore speech from other persons who are positioned within a beam of a beamformer of the device, with the consequence that such other persons' speech can corrupt the process of voice capture of the user only. These and other aspects of voice capture are particularly difficult to effect with earbuds, including for the reason that earbuds do not have a microphone positioned near the user's mouth and thus do not benefit from the significantly improved signal to noise ratio resulting from such microphone positioning.

Any discussion of documents, acts, materials, devices, articles or the like which has been included in the present specification is solely for the purpose of providing a context for the present invention. It is not to be taken as an admission that any or all of these matters form part of the prior art base or were common general knowledge in the field relevant to the present invention as it existed before the priority date of each claim of this application.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

In this specification, a statement that an element may be "at least one of" a list of options is to be understood that the element may be any one of the listed options, or may be any combination of two or more of the listed options.

SUMMARY OF THE INVENTION

According to a first aspect the present invention provides a signal processing device for earbud speech estimation, the device comprising:

at least one input for receiving a microphone signal from a microphone of an earbud;

at least one input for receiving a bone conduction sensor signal from a bone conduction sensor of an earbud;

a processor configured to determine from the bone conduction sensor signal at least one characteristic of speech of a user of the earbud, the at least one characteristic being a non-binary variable, the processor further configured to derive from the at least one characteristic of speech at least one signal conditioning parameter; and the processor further configured to use the at least one signal conditioning parameter to condition the microphone signal.

According to a second aspect the present invention provides a method of conditioning an earbud microphone signal, the method comprising:

receiving a bone conduction sensor signal from a bone conduction sensor of an earbud;

receiving a microphone signal from a microphone of the earbud;

determining from the bone conduction sensor signal at least one characteristic of speech of a user of the earbud, the at least one characteristic being a non-binary variable;

deriving from the at least one characteristic of speech at least one signal conditioning parameter; and using the at least one signal conditioning parameter to condition the output signal from the microphone.

According to a third aspect the present invention provides a non-transitory computer readable medium for conditioning an earbud microphone signal, comprising instructions which, when executed by one or more processors, causes performance of the following:

receiving a bone conduction sensor signal from a bone conduction sensor of an earbud;

receiving a microphone signal from a microphone of the earbud;

determining from the bone conduction sensor signal at least one characteristic of speech of a user of the earbud, the at least one characteristic being a non-binary variable;

deriving from the at least one characteristic of speech at least one signal conditioning parameter; and using the at least one signal conditioning parameter to condition the output signal from the microphone.

In some embodiments the earbud is a wireless earbud.

The non-binary variable characteristic of speech determined by the processor from the bone conduction sensor signal in some embodiments is a speech estimate derived from the bone conduction sensor signal. The processor may in some embodiments be configured such that the conditioning of the microphone signal comprises non-stationary noise reduction controlled by the speech estimate derived from the bone conduction sensor signal. The non-stationary noise reduction may in some embodiments be further controlled by a speech estimate derived from the microphone signal.

The processor may in some embodiments be configured such that the non-binary variable characteristic of speech determined from the bone conduction sensor signal is a speech level of the bone conduction sensor signal.

The processor may in some embodiments be configured such that the non-binary variable characteristic of speech determined from the bone conduction sensor signal is an observed spectrum of the bone conduction sensor signal.

The processor may in some embodiments be configured such that the non-binary variable characteristic of speech determined from the bone conduction sensor signal is a parametric representation of the spectral envelope of the bone conduction sensor signal.

The processor may in some embodiments be configured such that the parametric representation of the spectral envelope of the bone conduction sensor signal comprises at least one of: linear prediction cepstral coefficients, autoregressive coefficients, and line spectral frequencies, for example to model the human vocal tract in order to derive the speech envelope.

The processor may in some embodiments be configured such that the non-binary variable characteristic of speech determined from the bone conduction sensor signal is a non-parametric representation of the spectral envelope of the bone conduction sensor signal, such as mel-frequency cepstral coefficients (MFCCs) derived from models of human sound perception, or log-spaced spectral magnitudes derived from a short time Fourier transform which is a preferred method.

The processor may in some embodiments be configured such that the conditioning of the output signal from the microphone occurs irrespective of voice activity.

The processor may in some embodiments be configured such that the at least one signal conditioning parameter comprises band-specific gains derived from the bone conduction sensor signal, and wherein the conditioning of the microphone signal comprises applying the band-specific gains to the microphone signal.

The processor may in some embodiments be configured such that the conditioning of the microphone signal comprises applying a Kalman filter process in which the bone conduction sensor signal acts a priori to a speech estimation process. A speech estimate may in some embodiments be derived from the bone conduction sensor signal and be used to modify a decision-directed weighting factor for a priori SNR estimation. A speech estimate derived from the bone conduction sensor signal may in some embodiments be used to inform an update step in a casual recursive speech enhancement (CRSE).

The non-binary variable characteristic of speech determined by the processor from the bone conduction sensor signal may in some embodiments be a signal to noise ratio of the bone conduction sensor signal.

The processor may in some embodiments be configured such that, other than the bone conduction sensor signal being a basis for determination of the at least one characteristic of speech, no component of the bone conduction sensor signal is passed to a signal output of the earbud.

The processor may in some embodiments be configured such that, before the non-binary variable characteristic of speech is determined from the bone conduction sensor signal, the bone conduction sensor signal is corrected for observed conditions. The processor may in some embodiments be configured such that the bone conduction sensor signal is corrected for phoneme. The processor may in some embodiments be configured such that the bone conduction sensor signal is corrected for bone conduction coupling. The processor may in some embodiments be configured such that the bone conduction sensor signal is corrected for bandwidth. The processor may in some embodiments be configured such that the bone conduction sensor signal is corrected for distortion. The processor may in some embodiments be configured to perform the correction of the bone conduction sensor signal by applying a mapping process. The mapping process may in some embodiments comprise a linear mapping involving a series of corrections associated with each spectral bin of the bone conduction sensor signal. For example, the corrections may comprise a multiplier and offset applied to the respective spectral bin value of the bone conduction sensor signal. The processor may in some embodiments be configured to perform the correction of the bone conduction sensor signal by applying offline learning.

The processor may in some embodiments be configured such that the conditioning of the microphone signal is based only upon the non-binary variable characteristic of speech determined from the bone conduction sensor signal.

The bone conduction sensor may in some embodiments comprise an accelerometer, which in use is coupled to a surface of the user's ear canal or concha, to detect bone conducted signals from the user's speech.

The bone conduction sensor may in some embodiments be comprise an in-ear microphone which in use is positioned to detect acoustic sounds arising within the ear canal as a result of bone conduction of the user's speech. The accelerometer and the in-ear microphone may in some embodiments both be used to detect at least one characteristic of speech of the user.

The processor may in some embodiments be configured to apply at least one matched filter to the bone conduction sensor signal, the matched filter being configured to match the user's speech in the bone conduction sensor signal to the user's speech in the microphone signal. The matched filter may in some embodiments have a design which is based on a training set.

The processor may in some embodiments be configured to condition the microphone signal unilaterally, without input from any contralateral sensor on an opposite ear of the user.

An earbud is defined herein as an audio headset device, whether wired or wireless, which in use is supported only or substantially by the ear upon which it is placed, and which comprises an earbud body which in use resides substantially or wholly within the ear canal and/or concha of the pinna.

BRIEF DESCRIPTION OF THE DRAWINGS

An example of the invention will now be described with reference to the accompanying drawings, in which.

DETAILED DESCRIPTION OF PREFERRED EMBODIMENTS

Figure 1:
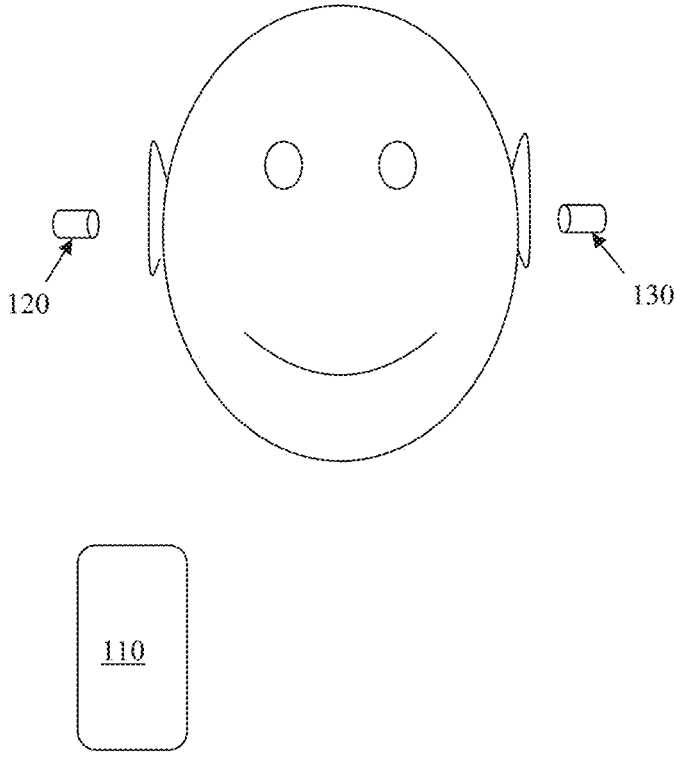
FIG. 1 illustrates the use of wireless earbuds for telephony and/or audio playback.

FIG. 1 illustrates the use of wireless earbuds for telephony and/or audio playback. Device 110, which may be a smartphone or audio player or the like, communicates with bilateral wireless earbuds 120, 130. For illustrative purposes earbuds 120, 130 are shown outside the ear however in use each earbud is placed so that the body of the earbud resides substantially or wholly within the concha and/or ear canal of the respective ear. Earbuds 120, 130 may each take any suitable form to comfortably fit upon or within, and be supported by, the ear of the user. In some embodiments within the scope of the present invention the body of the earbud may be further supported by a hook or support member extending beyond the concha such as partly or completely around the outside of the respective pinna.

Figure 2:
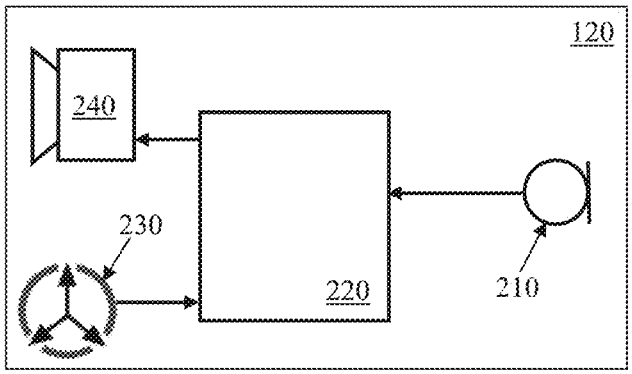
FIG. 2 is a system schematic of an earbud in accordance with one embodiment of the invention.

FIG. 2 illustrates the system of earbud 120. Earbud 130 may be similarly configured and is not described separately. A microphone 210 is positioned on earbud 120 so as to receive external acoustic signals when the earbud is in place. A plurality of microphones may be provided, for example in order to enable beamforming noise reduction to be undertaken by the earbud 120, however the small size of earbud 120 places a difficult limitation on the maximum microphone spacing which can be implemented, and the positioning of the earbud in a position where sound is partly occluded or diffused by the pinna are factors which both limit the efficacy of beamforming, as compared to say a boom-mounted microphone.

The microphone signal from microphone 210 is passed to a suitable processor 220 of earbud 120. Due to the size of earbud 120 limited battery power is available which dictates that processor 220 executes only low power and computationally simple audio processing functions.

Earbud 120 further comprises an accelerometer 230 which is mounted upon earbud 120 in a location which is inserted into the ear canal and pressed against a wall of the ear canal in use, or as appropriate accelerometer 230 may be mounted within a body of the earbud 120 so as to be mechanically coupled to a wall of the ear canal. Accelerometer 230 is thereby configured to detect bone conducted signals, and in particular the user's own speech as conducted by the bone and tissue interposed between the vocal tract and the ear canal. Such signals are referred to herein as bone conducted signals, even though acoustic conduction may occur through other body tissue and may partly contribute to the signal sensed by the bone conduction sensor 230.

The bone conduction sensor could in alternative embodiments be coupled to the concha or mounted upon any part of the headset body that reliably contacts the ear within the ear canal or concha. The use of an earbud allows for reliable direct contact with the ear canal and therefore a mechanical coupling to the vibration model of bone conducted speech as measured at the wall of the ear canal. This is in contrast to the external temple, cheek or skull, where a mobile device such as a phone might make contact. The present invention recognises that a bone conducted speech model derived from parts of the anatomy outside the ear produces a signal that is significantly less reliable for speech estimation as compared to described embodiments of this invention. The present invention recognises that use of a bone conduction sensor in a wireless earbud is sufficient to perform speech estimation. This is because, unlike a handset or a headset outside the ear, the nature of the bone conduction sensor signal from wireless earbuds is largely static with regard to the user fit, user actions and user movements. For example the present invention recognises that no compensation of the bone conduction sensor is required for fit or proximity Thus, selection of the ear canal or concha as the location for the bone conduction sensor is a key enabler for the present invention. In turn, the present invention then turns to deriving a transformation of that signal that best identifies the temporal and spectral characteristics of user speech.

The device 120 is a wireless earbud. This is important as the accessory cable attached to wired personal audio devices is a significant source of external vibration to the bone conduction sensor 230. The accessory cable also increases the effective mass of the device 120 which can damp vibrations of the ear canal due to bone conducted speech. Eliminating the cable also reduces the need for a compliant medium in which to house the bone conduction sensor 230. The reduced weight increases compliance with the ear canal vibration due to bone conducted speech. Therefore in wireless embodiments of the invention there is no or vastly reduced restrictions on placement of the bone conduction sensor 230. The only requirement is that sensor 230 makes rigid contact with the external housing of the earbud 120. Embodiments thus may include mounting the sensor 230 on a printed circuit board (PCB) inside the earbud housing or to a BTE module coupled to the earbud kernel via a rigid rod.

The position of the primary voice microphone 210 is generally close to the ear in wireless earbuds. It is therefore relatively distant from the user's mouth and consequently suffers from a low signal to noise ratio (SNR). This is in contrast to a handset or pendant type headset, in which the primary voice microphone is much closer to the mouth, and in which differences in how the user holds the phone/pendant can give rise to a wide range of SNR. In the present embodiment the SNR on the primary voice microphone 210 for a given environmental noise level is not so variable as the geometry between the user's mouth and the ear containing the earbud is fixed. Therefore the ratio between the speech level on the primary voice microphone 210 and the speech level on the bone conduction sensor 230 are known a priori and the present invention therefore recognises that this is in part useful for determining the relationship between the true speech estimate and the bone conduction sensor signal.

The sufficient condition of contact between the bone conduction sensor 230 and the ear canal is due to the weight of the earbud 120 being small enough that the force of the vibration due to speech exceeds the minimum sensitivity of commercial accelerometers 230. This is in contrast to an external headset or phone handset which has a large mass which prevents bone conducted vibrations from easily coupling to the device.

Processor 220 is a signal processing device configured to determine from the bone conduction sensor signal from accelerometer 230 at least one characteristic of speech of a user of the earbud 120, derive from the at least one characteristic of speech at least one signal conditioning parameter; and the processor 220 is further configured to use the at least one signal conditioning parameter to condition the microphone signal from microphone 210 and wirelessly deliver the conditioned signal to master device 110 for use as the transmitted signal of a voice call and/or for use in automatic speech recognition (ASR). Communications between earbud 120 and master device 110 may for example be undertaken by way of low energy Bluetooth. Alternative embodiments may utilise wired earbuds and communicate by wire, albeit with the disadvantages discussed elsewhere herein. Speaker 240 is configured to play back acoustic signals into the ear canal of the user, such as a receive signal of a voice call.

Notably, the present embodiment provides for noise reduction to be applied in a controlled gradated manner, and not in a binary on-off manner, based upon a speech estimation derived from the bone conduction sensor signal, on a headset form factor comprising a wireless earbud provided with at least one microphone and at least one accelerometer. In particular, in contrast to the binary process of voice activity detection, speech estimation involves the estimation of spectral amplitudes or signal peak frequencies and the application of suitable processing to improve speech quality. Indeed some embodiments of the present invention may apply speech estimation based on the bone conduction sensor signal in the absence of any voice activity detection and microphone signal gating step whatsoever.

Accurate speech estimates can lead to better performance on a range of speech enhancement metrics. Voice activity detection (VAD) is one way of improving the speech estimate but inherently relies on the imperfect notion of identifying in a binary manner the presence or absence of speech in noisy signals. The present embodiment recognises that the accelerometer 230 can capture a suitable noise-free speech estimate that can be derived and used to drive speech enhancement directly, without relying on a binary indicator of speech or noise presence. A number of solutions follow from this recognition.

Figure 3A:
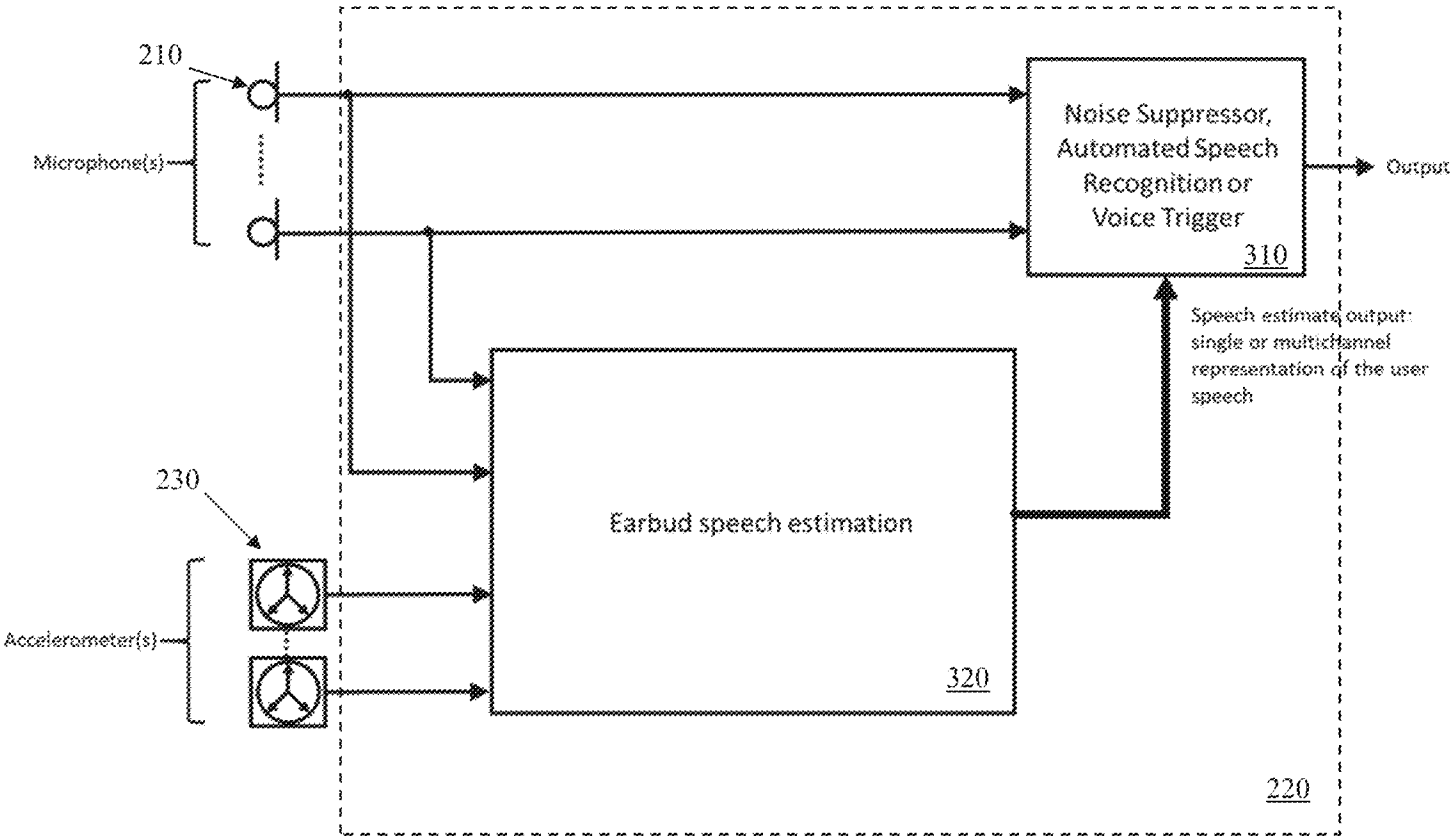
FIGS. 3*a* and 3*b* are detailed system schematics of the earbud of FIG. 2.
Figure 3B:
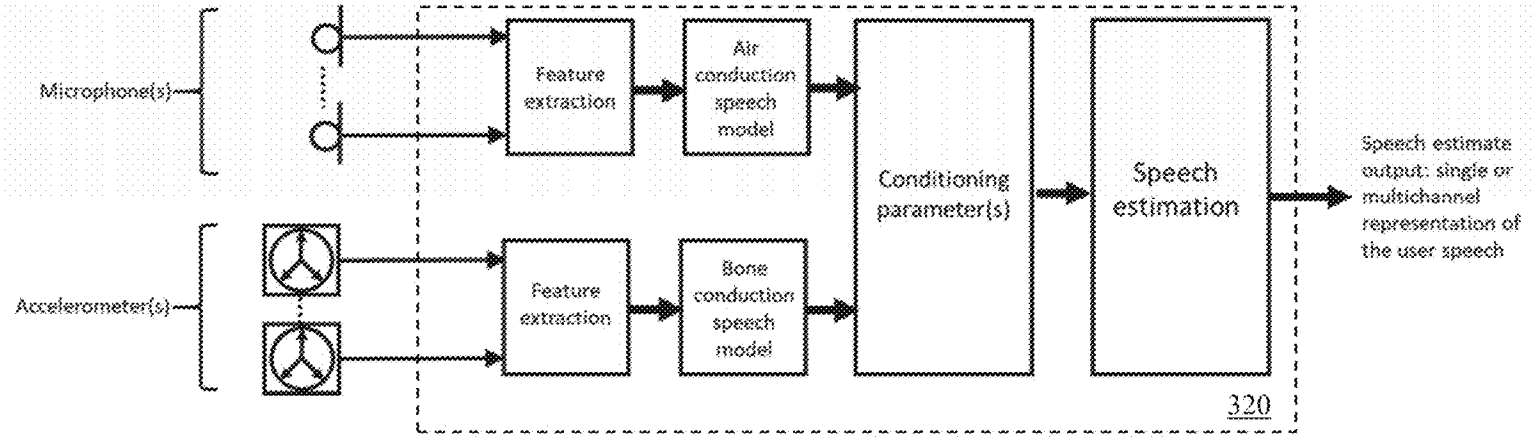

FIGS. 3*a* and 3*b* illustrate in greater detail the configuration of processor 220 within the system of earbud 120, in accordance with one embodiment of the invention. The embodiment of FIGS. 3*a* and 3*b* recognises that in moderate signal to noise ratio (SNR) conditions, improved non-stationary noise reduction can be achieved with speech estimates alone, without VAD. This is distinct from approaches in which voice activity detection is used to discriminate between the presence of speech and the absence of speech, and a discrete binary decision signal from the VAD is used to gate, i.e. turn on and off, a noise suppressor acting on an audio signal. The embodiment of FIG. 3 recognises that the accelerometer signal or some signal derived from it may be relied upon to obtain sufficiently accurate speech estimates, even in acoustic conditions where accurate speech estimations cannot be obtained from the microphone signal. Omission of the VAD in such embodiments contributes to minimising the computational burden on the earbud processor 220.

In more detail, in FIG. 3 the microphone signal from microphone 210 is conditioned by a noise suppressor 310, and then passed to an output, such as for wireless communication to device 110. The noise suppressor 310 is continually controlled by speech estimation/characterisation module 320, without any on-off gating by any VAD. Speech estimation/characterisation module 320 takes inputs from accelerometer 230, and optionally also from other accelerometers, microphone 210, and/or other microphones.

The selection of an accelerometer 230 as the bone conduction sensor in such embodiments is particularly useful because the noise floor in commercial accelerometers is, as a first approximation, spectrally flat. These devices are acoustically transparent up to the resonant frequency and so display no signal due to environmental noise. The noise distribution of the sensor 230 can therefore be updated a priori to the speech estimation process. This is an important difference as it permits modelling of the temporal and spectral nature of the true speech signal without interference by the dynamics of a complex noise model. Experiments show that even tethered (wired) earbuds have a complex noise model due to short term changes in the temporal and spectral dynamics of noise due to events such as cable bounce. Corrections to the bone conduction spectral envelope in wireless earbud 120 are not required as a matched signal is not a requirement for the design of a conditioning parameter.

Speech estimation 320 is performed on the basis of certain signal guarantees in the microphone(s) 210 and accelerometers 230, as are guaranteed in the wireless earbud use case in particular. However, corrections to the bone conduction spectral envelope in an earbud may be performed to weight feature importance but a matched signal is not a requirement for the design of a conditioning parameter. Sensor non-idealities and non-linearities in the bone conduction model of the ear canal are other reasons a correction may be applied.

In particular, embodiments employing multiple bone conduction sensors 230 in the ear are proposed to be configured so as to exploit orthogonal modes of vibration arising from bone conducted speech in the ear canal in order to extract more information about the user speech. Importantly, the bone conducted signal couples reliably into the sensors within the scope of wireless earbuds, unlike wired earbuds to an extent, and unlike headsets outside the ear. In such embodiments the problem of capturing various modalities of bone conducted speech in the ear canal is solved by the use of multiple bone conduction devices arranged orthogonally in the earbud housing, or by a single bone conduction device with independent orthogonal axes.

The signal from accelerometer 230 is high pass filtered and then used by module 320 to determine a speech estimate output which may comprise a single or multichannel representation of the user speech, such as a clean speech estimate, the a priori SNR, and/or model coefficients.

Notably, the configuration of FIG. 3 omits any voice activity detection (VAD). Numerous methods of speech enhancement rely on various estimates of the speech signal, and become challenging when microphone speech signals become degraded by environmental noise. The accuracy of these estimates generally diminishes with the level of environmental noise. The uses for speech estimates include wind noise suppression, a priori SNR estimation for noise suppression, biasing of the gain function for noise suppression, beamforming adaption (blocking matrix update), adaption control for acoustic echo cancellation, a priori speech to echo estimation for echo suppression, adaptive thresholding for VAD (level difference and cross-correlation), and adaptive windowing for stationary noise estimates (minima controlled recursive averaging (MCRA)).

The processing of the bone conduction sensor 230 and consequent conditioning occurs irrespective of speech activity in an accelerometer signal in this embodiment of the invention. It is therefore not dependent on either a speech detection process or noise modelling (VAD) process in deriving the speech estimate for a noise reduction process. The noise statistics of an accelerometer sensor 230 measuring ear canal vibrations in a wireless earbud 120 have a well-defined distribution unlike the handset use case. The present invention recognises that this justifies a continuous speech estimation based on the signal from accelerometer 230. Although the microphone 210 SNR will be lower in an earbud due to distance of the microphone 210 from the mouth, the distribution of speech samples will have a lower variance than that of a handset or pendant due to the fixed position of the earbud and microphone 210 relative to the mouth. This collectively forms the a priori knowledge of the user speech signal to be used in the conditioning parameter design and speech estimation processes 320.

The embodiment of FIG. 3 recognises that speech estimation using a microphone and bone conduction sensor can improve speech estimation for such purposes. The speech estimate may be derived from the bone conduction sensor (e.g. accelerometer 230) or a combination of both bone conduction sensor(s) 230 and microphone(s) 210. The speech estimate from the bone conduction sensor 230 may comprise any combination of signals from separate axes of a single device. The speech estimate may be derived from time domain or frequency domain signals. By undertaking the processing within the earbud 120 rather than in master device 110, the processor 220 can be configured at a time of manufacture or configuration with certainty that the described processes have access to all of the appropriate signals and are based on precise knowledge of the earbud geometry.

Before the non-binary variable characteristic of speech is determined from the bone conduction sensor signal, the bone conduction sensor signal is corrected for observed conditions, and for example the bone conduction sensors signal may be corrected for phoneme, sensor bandwidth and/or distortion. The correction may involve a linear mapping which undertakes a series of corrections associated with each spectral bin, such as applying a multiplier and offset to each bin value.

The speech estimates may be derived at 320 from the bone conduction sensor 230 by any of the following techniques: exponential filtering of signals (leaky integrator); gain function of signal values; fixed matching filter (FIR or spectral gain function);

adaptive matching (LMS or input signal driven adaptation); mapping function (codebook); and using second order statistics to update an estimation routine. In addition, speech estimates may be derived from different signals for different amplitudes of the input signals, or other metric of the input signals such as noise levels. For example, the accelerometer 230 noise floor is much higher than the microphone 210 noise floor, and so below some nominal level the accelerometer information may no longer be as useful and the speech estimate can transition to a microphone-derived signal. The speech estimates as a function of input signals may be piecewise or continuous over transition regions. Estimation may vary in method and may rely on different signals with each region of the transfer curve. This will be determined by the use case, such as a noise suppression long term SNR estimate, noise suppression a priori SNR reduction, and gain back-off.

Figure 4:
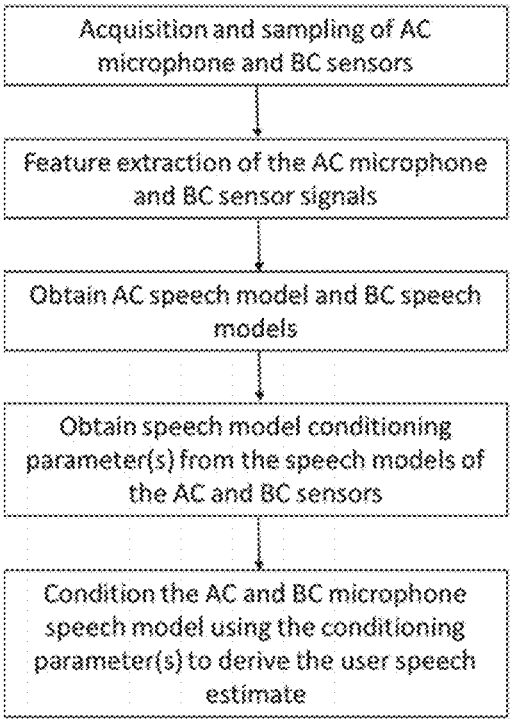
FIG. 4 is a flow diagram for the earbud speech estimation process of the embodiment of FIG. 3.

FIG. 3*b* provides more detail of the earbud speech estimation process 320 of FIG. 3*a*. FIG. 4 is a flow diagram for the earbud speech estimation process.

Notably, FIGS. 3*a* and 3*b* describe a speech estimator 320 conditioned on the bone conduction speech signal from 230. This estimation may take the form of a time and/or frequency domain signal representative of the user speech signal. This is distinct from a clean speech signal that may be the result of an application of this estimator 320.

Figure 5:
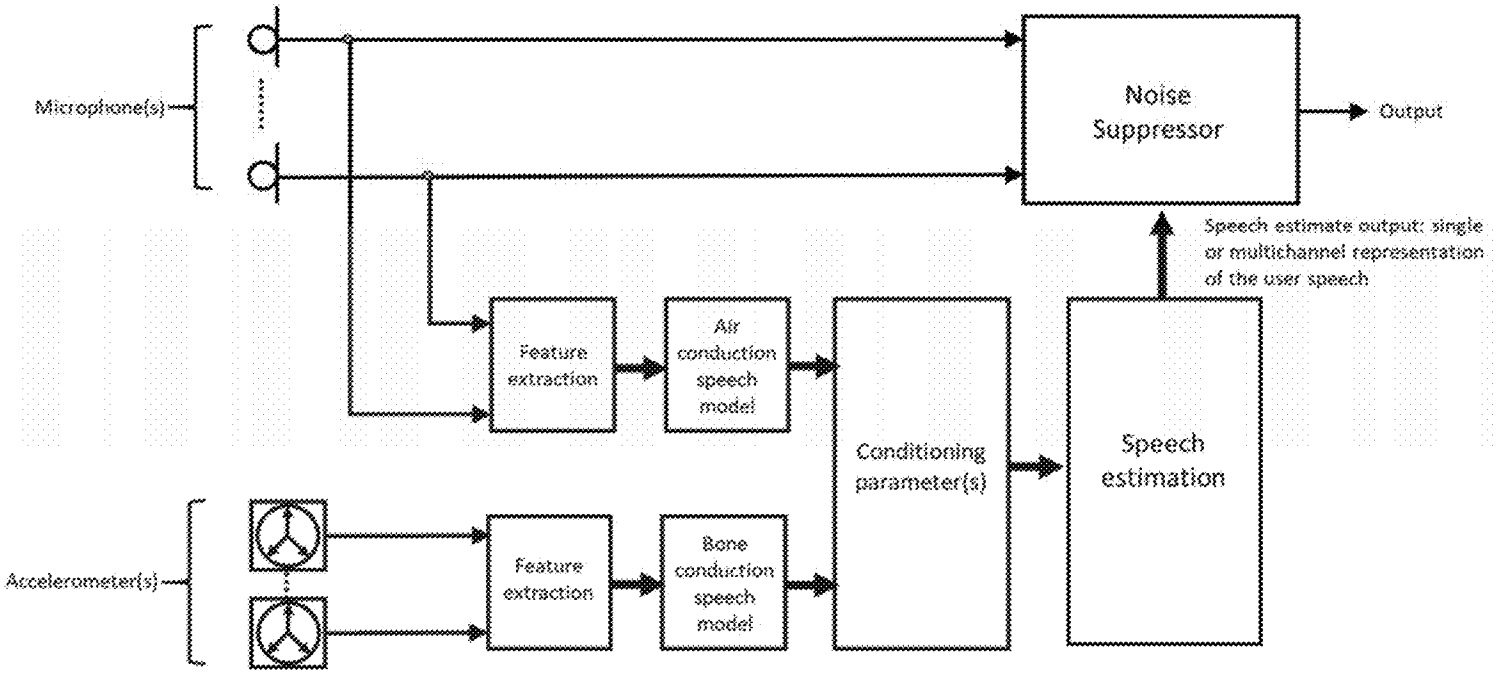
FIG. 5 illustrates a noise suppressor for telephony in accordance with another embodiment of the invention.

A noise suppressor for telephony as shown in FIG. 5 may use the estimator in producing a clean speech signal that will be transferred across a telephony network to a remote recipient. Examples of noise suppressors include Spectral Subtraction, Wiener Filtering and Statistical Model Methods.

Figure 6:
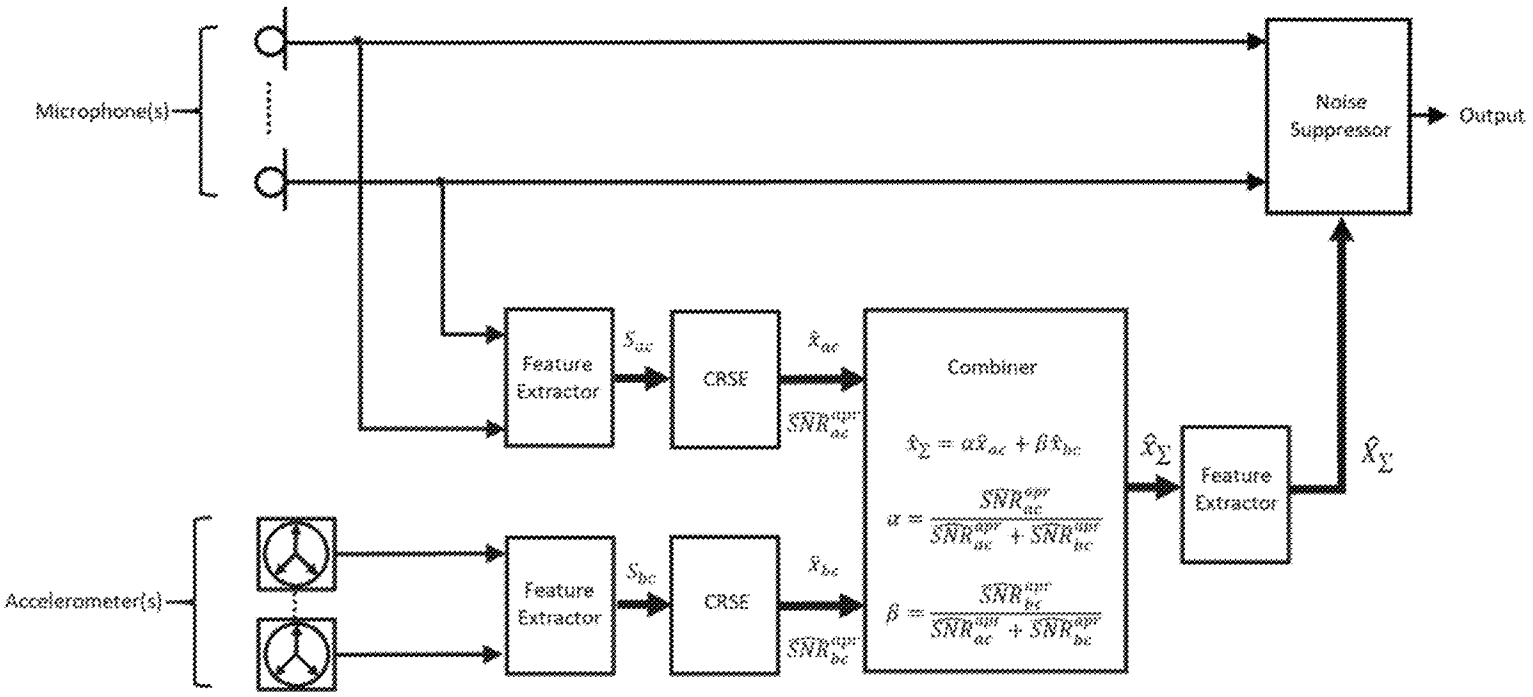
FIG. 6 illustrates an embodiment comprising a speech estimator that uses a statistical model based estimation process.

An example of an embodiment of the speech estimator that uses a statistical model based estimation process is shown in FIG. 6. The air conducted microphone speech estimate, the bone conducted speech estimate and SNR are separately derived from a causal recursive speech enhancement process. A priori SNR estimates from each process are then combined to derive mixing coefficients that condition the user speech estimates to arrive at a final speech estimator. It is important to note that neither the microphone nor the accelerometer sensor signals are used to derive a noise model in this process. Instead the information content within the signals as influenced by the wireless earbud form factor allow a direct speech estimation process.

In another example the application may be in producing a signal representative of a latent representation of speech suitable for an Automated Speech Recognition (ASR) system. In this case the latent representation of the clean speech is derived from a transformation of the speech estimator.

The distinction of this approach is recognised in the exploitation of the temporal and spectral dynamics of the bone conduction signal in the presence of a stationary noise signal to derive a speech model. This is in contrast to the exploitation of the same dynamics for speech detection which find widespread application in the field of voice activity detectors.

Corrections to the bone conduction spectral envelope in an earbud may be performed to weight feature importance but a matched signal is not a requirement for the design of a conditioning parameter.

The approach to derive a speech estimator, in contrast to a speech detector (VAD), using the bone conduction sensor can be further elaborated upon within the context of this invention. Traditionally the quality of noise suppressors is dependent on estimates of the noise spectrum. The noise spectrum is typically derived from measurement during speech gaps with a binary decision device such as a VAD. VADs tend to perform poorly in low SNR conditions resulting in errors in the gain function that give rise to the familiar undesirable 'musical noise' phenomena. Alternatively, noise estimates may be obtained by assuming certain statistical properties of the noise signal however, noise statistics of realistic environments can deviate from these assumptions. Since the accuracy of the gain function is highly dependent on the SNR estimate this means that, in the absence of accurate noise statistics, SNR estimation can exploit knowledge of the speech estimate.

The present invention does not use the bone conduction sensor in the process of building a noise model. Therefore construction of a noise model does not require a voice activity detector (VAD) derived from the bone conduction sensor. This is an important contrast with other proposals to use a bone conduction sensor as a substitute for a microphone, as in such alternative proposals typically the noise model must be accurately modelled for performing speech enhancement and therefore the bone conduction sensor is instrumental in deriving that model.

The bone conduction sensor in the present invention is for deriving one or more conditioning parameters for the microphone speech envelope, and is inherently bone conduction VAD-free. The nature of wireless earbuds as previously discussed avoids the need to consider a complex noise model introduced by the bone conduction sensor. In contrast the underlying assumption of the bone conduction sensor in the earbud is that the bone conduction sensor signal representative of speech contains the temporal and spectral content sufficient for deriving a non-binary signal representative of user speech. Thus, the present invention recognises that in the earbud use case the clean speech estimate is not dependent on a bone conduction derived noise estimate. Indeed, the inclusion of a noise model is optional when forming the clean speech estimate although in some instances it may improve the clean speech estimate.

In one embodiment (FIG. 6) the speech model from the noisy microphone may be refined with a causal recursive speech estimator which requires an estimate of the noise variance. This is typically a minimal-tracking or time-recursive averaging algorithm and such estimation is performed in the absence of any specific speech detection. Further, the power spectrum of the bone conduction sensor is by virtue of its representation of ear canal vibration, treated as a prior of the user speech. It need not undergo a transformation to approximate a clean speech microphone signal. In this case it is treated as $S_{bc}$, a bone conduction speech estimate, rather than a clean speech estimate conditioned on the bone conduction sensor i.e. $\hat{S}_{x|bc}$. In some embodiments $S_{bc}$ may be further refined, for example by the aforementioned CRSE process. Thus, the present embodiments use the bone conduction sensor signal as a prior for clean speech estimation. Notably, these embodiments do not use an offline process to derive a bone conduction to clean air conduction microphone transformation, nor do these embodiments use such as resultant signal as a conditional estimate. Some embodiments of the invention may apply corrections for some non-idealities but, importantly, it is not necessary to add prior information to the signal from any offline process. The present invention recognises that it is possible to do so because the bone conduction sensor signal as a prior is sufficient because of the earbud use case.

Figure 7:
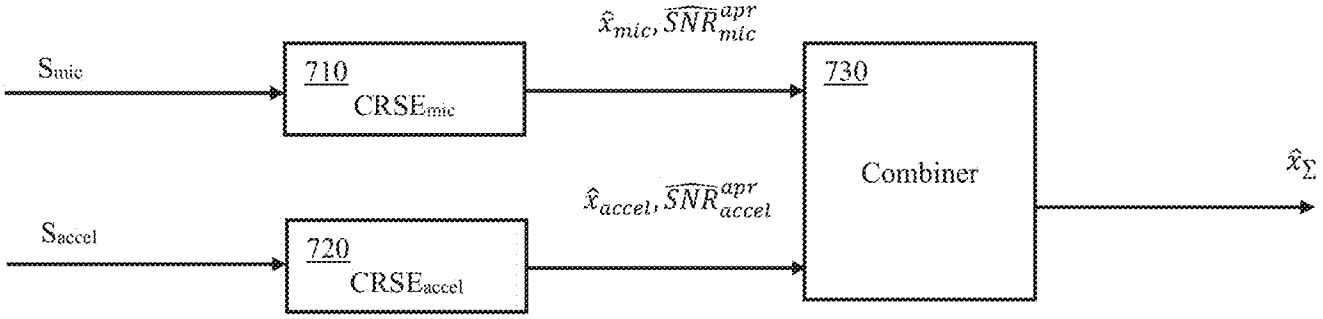
FIG. 7 illustrates a mic-accelerometer mixing approach which is based on mixing factors using SNR estimates.

FIG. 7 illustrates a mic-accelerometer mixing approach which is based on mixing factors using SNR estimates and provides a means to combine a priori SNR estimates from the mic and accelerometer (BC sensor). This may be particularly suitable in low SNR environments where the best speech estimate in terms of the SNR estimate is being used. The clean speech estimate and a priori SNR estimates derived from the bone conduction sensor signal are thus an application of the bone conduction sensor signal-controlled speech estimation technique in accordance with the present invention. It is to be noted in FIG. 7 that the mixing is achieved without use of a VAD. For example, in one approach of mixing the combiner 730 mixes noisy microphone (mic) and bone conduction sensor (accel) signals according to mixing factors α and β derived from respective a priori (apr) SNR estimates as follows:

$$\hat{x}_{\Sigma} = \alpha\hat{x}_{mic} + \beta\hat{x}_{accel}$$

$$\alpha = \frac{\widehat{SNR}_{mic}^{apr}}{\widehat{SNR}_{mic}^{apr} + \widehat{SNR}_{accel}^{apr}}$$

$$\beta = \frac{\widehat{SNR}_{accel}^{apr}}{\widehat{SNR}_{mic}^{apr} + \widehat{SNR}_{accel}^{apr}}$$

and then a second stage noise reduction is performed on this mixed signal.

This is in contrast to using a VAD to derive noise estimates and to subsequently determine mixing ratios.

Further embodiments of the present invention may enlarge upon this idea by discarding speech estimates from the speech enhancement blocks 710, 720, instead mixing the noisy signals from SNR estimates and performing a second-stage noise reduction.

Figure 8:
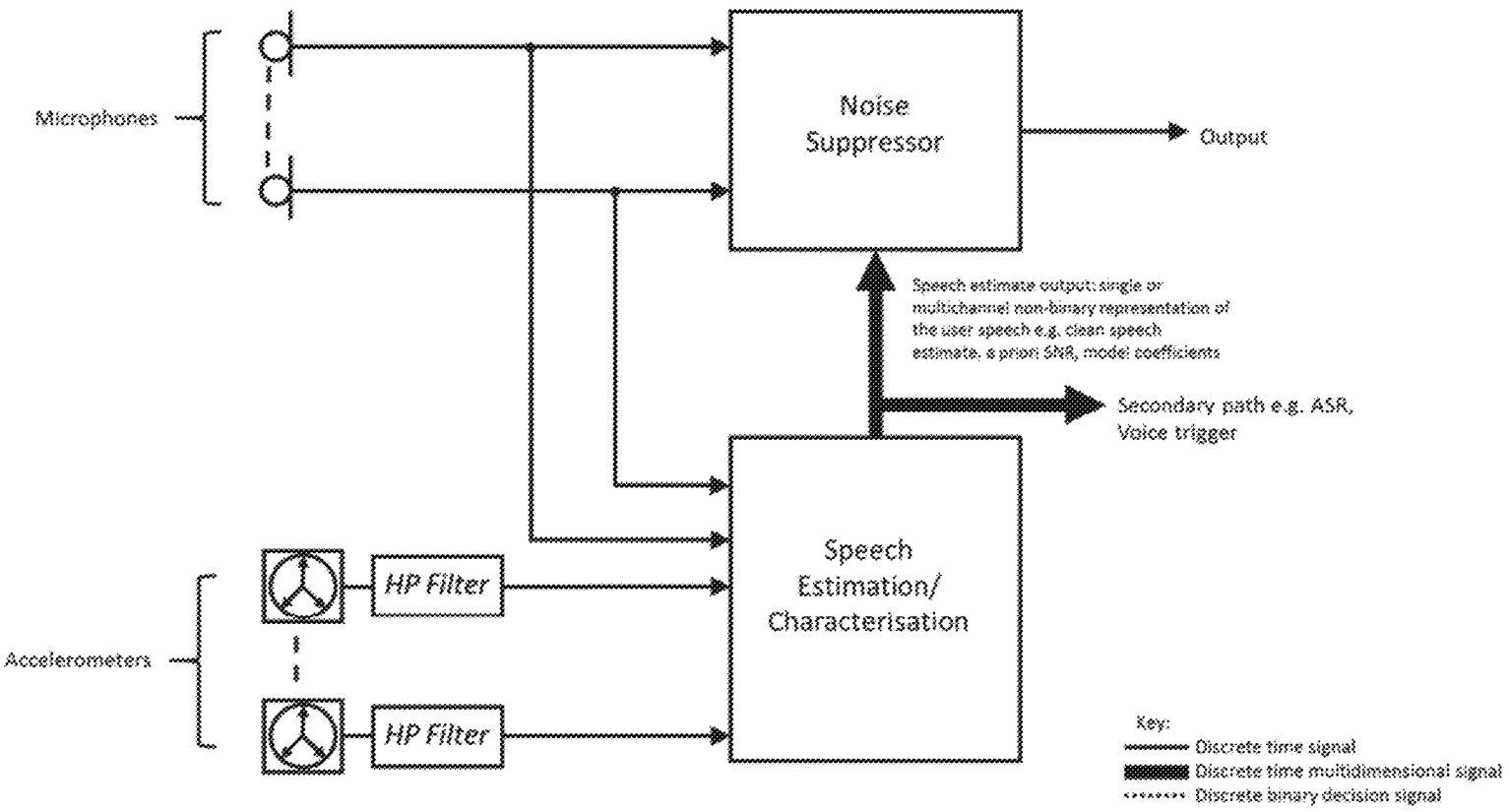
FIG. 8 illustrates the configuration of another embodiment of the invention.

FIG. 8 illustrates the configuration of processor 220 within the system of earbud 120, in accordance with another embodiment of the invention. Elements of FIG. 8 not described are as for FIG. 3. However, in the embodiment of FIG. 8 the speech estimate output by the speech estimation/characterisation module is delivered not only to the noise suppressor but also to a secondary output path for use by other modules which may for example be within the earbud 120 or the master device 110, and for example could include an automatic speech recognition (ASR) module or could be a voice-triggered module. Design of an appropriate gain function takes place inside the noise suppression model and relies on the conditioned speech estimate of the microphone signal.

Figure 9:
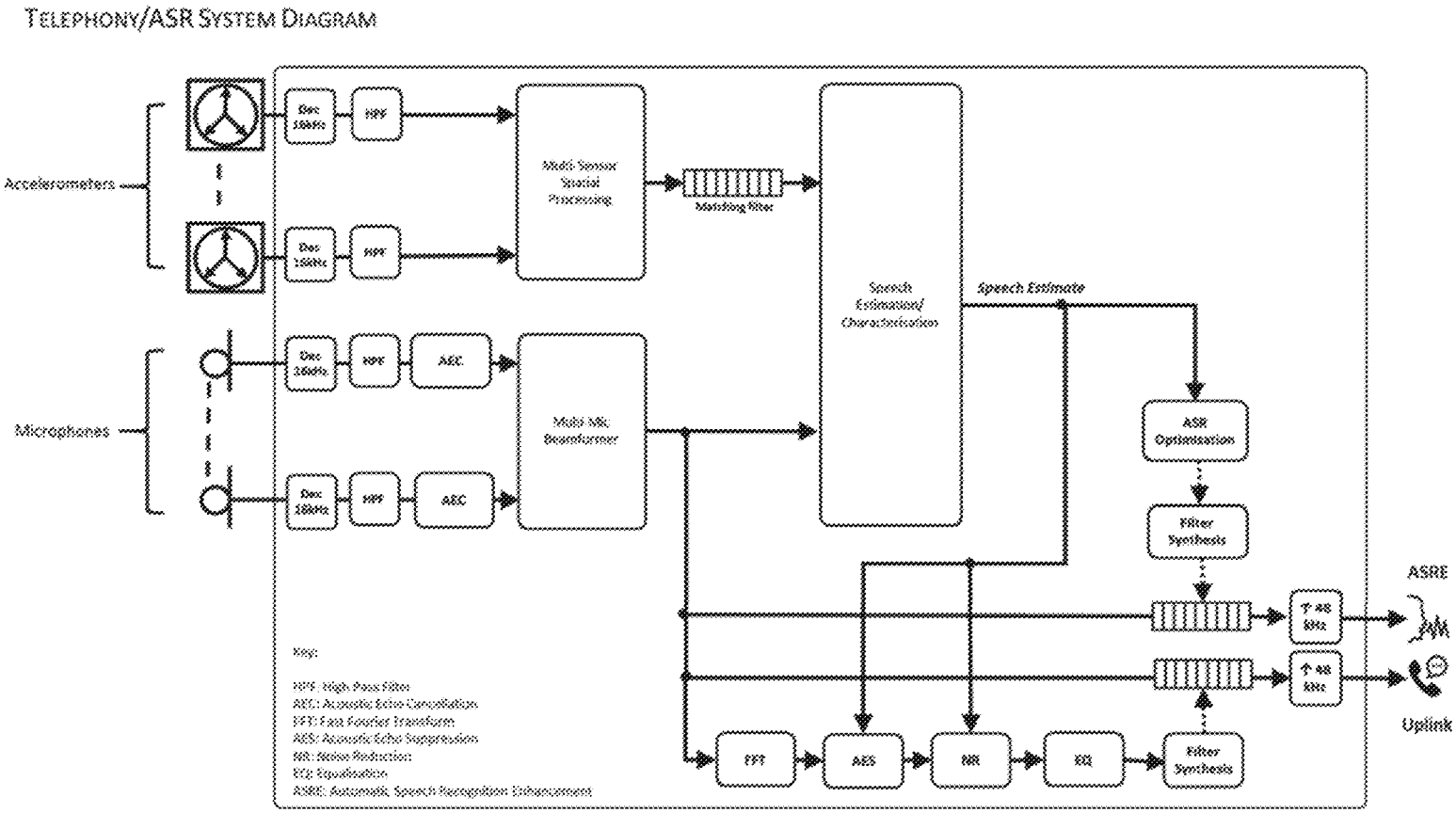
FIG. 9 illustrates an embodiment applying speech estimation from a bone conduction sensor signal to the telephony use case.

FIG. 9 illustrates a further embodiment in accordance with the present invention, illustrating the application of the speech estimation from the bone conduction sensor signal to the telephony use case.

Embodiments of the present invention note that, despite the poor frequency response of in-ear accelerometers as compared to microphones and even as compared to temple mounted bone sensors or the like, it is nevertheless possible to not only use in-ear accelerometer signals for speech estimation but moreover it is recognised that in-ear accelerometer signals may be used for gradated or non-binary control of speech estimation, such as by controlling non-stationary noise reduction in a multi-stepped or gradated manner. In more detail, the low pass frequency response of earbud inertial sensors, and relatively poor sensitivity, are limitations of the bone conduction model at the outer ear canal. Bone conduction sensors for vibration are typically magnetic type and mounted to other parts of the head such as the temporal bone or mastoid bone, often utilising a spring force of a headband or the like to maintain a firm contact. Such mounting locations and techniques however are somewhat incongruent with headsets for audio applications and not compatible with preferred headset form factors. The present invention, in utilising an inertial sensor of an earbud, is beneficial in conforming to a preferred headset form factor.

The speech spectral envelope in the present embodiments is not a convex combination of microphone signal, noise model and bone conduction signal. This is not practical given the spectral nature of the accelerometer signal used in one of our embodiments since the bone conduction model of speech in the ear canal limits the observable frequency range. Bone conduction models based on other parts of the body can exploit modes of high frequency radiation in excess of 1 kHz. Estimating a time-frequency model of speech in the ear canal is therefore a different problem as the present inventors have discovered that the observable frequency range of ear canal bone conduction signals is typically below 1 kHz. The present inventors have shown however that temporal and spectral information available from the accelerometer even in such a limited band nevertheless adds information about the nature of the true clean speech that can inform the noise reduction process in a useful way.

Figure 10:
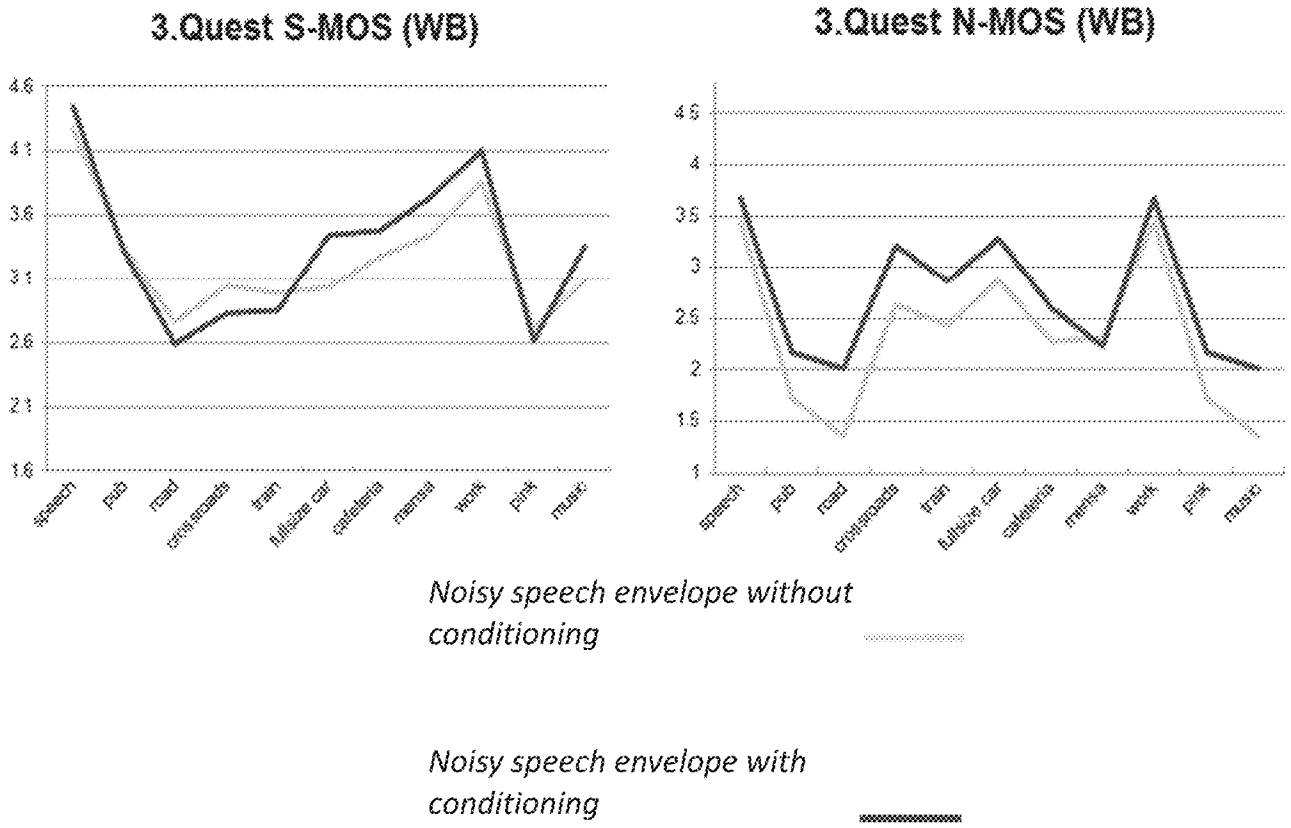
FIG. 10 shows objective Mean Opinion Score (MOS) results for one embodiment of the invention.

FIG. 10 shows objective Mean Opinion Score (MOS) results for the embodiment of FIG. 9, showing the improvement when the a priori speech envelope from the microphone 210 is conditioned with a parameter(s) derived from the bone conduction sensor 230 spectral envelope. The measurements are performed in a number of different stationary and non-stationary noise types using the 3Quest methodology to obtain speech MOS (S-MOS) and noise MOS (N-MOS) values.

While in other applications such as handsets bone conduction and microphone spectral estimates in the combined estimates have time and frequency contribution that may fall to zero if the handset use case forces either sensor signal quality to be very poor, this is not the case in the wireless earbud application of the present embodiments. In contrast the a priori speech estimates of the microphone 210 and accelerometer 230 in the earbud form factor can be combined in a continuous way. For example, provided the earbud 120 is being worn by the user, the accelerometer sensor model will always provide a signal representative of user speech to the conditioning parameter design process. As such, the microphone speech estimate is continuously being conditioned by this parameter.

While the described embodiments provide for the speech estimation/characterisation 320 module and the noise suppressor module 310 to reside within earbud 120, alternative embodiments may instead or additionally provide for such functionality to be provided by master device 110. Such embodiments may thus utilise the significantly greater processing capabilities and power budget of master device 110 as compared to earbuds 120, 130.

Earbud 120 may further comprise other elements not shown such as further digital signal processor(s), flash memory, microcontrollers, Bluetooth radio chip or equivalent, and the like.

The described embodiments utilise accelerometer 230 as the bone conducted signal sensor. However, alternative embodiments may sense bone conducted signals by additionally or alternatively providing one or more in-ear microphones. Such in-ear microphones will, unlike accelerometer 230, receive acoustic reverberations of bone conducted signals which reverberate within the ear canal, and will also receive leakage of external noise into the ear canal past the earbud. However, the present inventors recognise that the earbud provides a significant occlusion of such external noise, and moreover that active noise cancellation (ANC) when employed will further reduce the level of external noise inside the ear canal without significantly reducing the level of bone conducted signal present inside the ear canal, so that an in-ear microphone may indeed capture very useful bone-conducted signals to assist with speech estimation in accordance with the present invention. Additionally, such in-ear microphones may be matched at a hardware level with the external microphone 210, and may capture a broader spectrum than an accelerometer, and thus the use of one or more in-ear microphones may present significantly different implementation challenges to the use of an accelerometer(s).

The claimed electronic functionality can be implemented by discrete components mounted on a printed circuit board, or by a combination of integrated circuits, or by an application-specific integrated circuit (ASIC). Wireless communications is to be understood as referring to a communications, monitoring, or control system in which electromagnetic or acoustic waves carry a signal through atmospheric or free space rather than along a wire.

Corresponding reference characters indicate corresponding components throughout the drawings.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. A signal processing device for earbud speech estimation, the device comprising:

at least one input for receiving a microphone signal from a microphone of an earbud;

at least one input for receiving a bone conduction sensor signal from a bone conduction sensor of an earbud;

a processor configured to determine from the bone conduction sensor signal at least one characteristic of speech of a user of the earbud, the at least one characteristic being a non-binary variable, the processor further configured to derive from the at least one characteristic of speech at least one signal conditioning parameter; and the processor further configured to use the at least one signal conditioning parameter to condition the microphone signal;

wherein the processor is configured such that the conditioning of the output signal from the microphone by the at least one signal conditioning parameter occurs irrespective of voice activity;

wherein the non-binary variable characteristic of speech determined by the processor from the bone conduction sensor signal is a speech estimate derived from the bone conduction sensor signal; and wherein the microphone signal is conditioned without using any binary indicators of speech.

2. The signal processing device according to claim 1, wherein the earbud is a wireless earbud.

3. The signal processing device according to claim 1 wherein the processor is configured such that the conditioning of the microphone signal comprises non-stationary noise reduction controlled by the speech estimate derived from the bone conduction sensor signal.

4. The signal processing device according to claim 3 wherein non-stationary noise reduction is further controlled by a speech estimate derived from the microphone signal.

5. The signal processing device according to claim 1 wherein the processor is configured such that the non-binary variable characteristic of speech determined from the bone conduction sensor signal is a speech level of the bone conduction sensor signal.

6. The signal processing device according to claim 1 wherein the processor is configured such that the non-binary variable characteristic of speech determined from the bone conduction sensor signal is an observed spectrum of the bone conduction sensor signal.

7. The signal processing device according to claim 6 wherein the processor is configured such that the non-binary variable characteristic of speech determined from the bone conduction sensor signal is a parametric representation of the spectral envelope of the bone conduction sensor signal.

8. The signal processing device according to claim 1 wherein the processor is configured such that the at least one signal conditioning parameter comprises band-specific gains derived from the bone conduction sensor signal, and wherein the conditioning of the microphone signal comprises applying the band-specific gains to the microphone signal.

9. The signal processing device according to claim 1 wherein the processor is configured such that the conditioning of the microphone signal comprises applying a Kalman filter process in which the bone conduction sensor signal acts a priori to a speech estimation process.

10. The signal processing device according to claim 1 wherein the non-binary variable characteristic of speech determined by the processor from the bone conduction sensor signal is a signal to noise ratio of the bone conduction sensor signal.

11. The signal processing device according to claim 1 wherein the processor is configured such that, other than the bone conduction sensor signal being a basis for determination of the at least one characteristic of speech, no component of the bone conduction sensor signal is passed to a signal output of the earbud.

12. The signal processing device according to claim 1 wherein the processor is configured such that, before the non-binary variable characteristic of speech is determined from the bone conduction sensor signal, the bone conduction sensor signal is corrected for observed conditions.

13. The signal processing device according to claim 1 wherein the processor is configured such that the conditioning of the microphone signal is based only upon the non-binary variable characteristic of speech determined from the bone conduction sensor signal.

14. The signal processing device according to claim 1 wherein the bone conduction sensor comprises an accelerometer, which in use is coupled to a surface of the user's ear canal or concha, to detect bone conducted signals from the user's speech.

15. The signal processing device according to claim 1 wherein the bone conduction sensor comprises an in-ear microphone which in use is positioned to detect acoustic sounds arising within the ear canal as a result of bone conduction of the user's speech.

16. The signal processing device according to claim 1 wherein the processor is configured to apply at least one matched filter to the bone conduction sensor signal, the matched filter being configured to match the user's speech in the bone conduction sensor signal to the user's speech in the microphone signal.

17. A method of conditioning an earbud microphone signal, the method comprising:

receiving a bone conduction sensor signal from a bone conduction sensor of an earbud;

receiving a microphone signal from a microphone of the earbud;

determining from the bone conduction sensor signal at least one characteristic of speech of a user of the earbud, the at least one characteristic being a non-binary variable;

deriving from the at least one characteristic of speech at least one signal conditioning parameter; and using the at least one signal conditioning parameter to condition the output signal from the microphone;

wherein conditioning of the output signal from the microphone by the at least one signal conditioning parameter occurs irrespective of voice activity;

wherein the non-binary variable characteristic of speech determined by the processor from the bone conduction sensor signal is a speech estimate derived from the bone conduction sensor signal; and wherein the microphone signal is conditioned without using any binary indicators of speech.

18. A non-transitory computer readable medium for conditioning an earbud microphone signal, comprising instructions which, when executed by one or more processors, causes performance of the following:

receiving a bone conduction sensor signal from a bone conduction sensor of an earbud;

receiving a microphone signal from a microphone of the earbud;

determining from the bone conduction sensor signal at least one characteristic of speech of a user of the earbud, the at least one characteristic being a non-binary variable;

deriving from the at least one characteristic of speech at least one signal conditioning parameter; and using the at least one signal conditioning parameter to condition the output signal from the microphone;

wherein conditioning of the output signal from the microphone by the at least one signal conditioning parameter occurs irrespective of voice activity;

wherein the non-binary variable characteristic of speech determined by the processor from the bone conduction sensor signal is a speech estimate derived from the bone conduction sensor signal; and wherein the microphone signal is conditioned without using any binary indicators of speech.

* * * * *